US007096759B2

(12) United States Patent
Kirko

(10) Patent No.: US 7,096,759 B2
(45) Date of Patent: Aug. 29, 2006

(54) METHOD AND APPARATUS FOR OPENING OF CONTAINERS

(76) Inventor: Edward Kirko, P.O. Box 726, Old Saybrook, CT (US) 06475

( * ) Notice: Subject to any disclaimer, the term of this patent is extended or adjusted under 35 U.S.C. 154(b) by 215 days.

(21) Appl. No.: 10/648,423

(22) Filed: Aug. 25, 2003

(65) Prior Publication Data

US 2004/0045410 A1 Mar. 11, 2004

Related U.S. Application Data

(60) Provisional application No. 60/406,074, filed on Aug. 27, 2002.

(51) Int. Cl.
*B67B 7/00* (2006.01)

(52) U.S. Cl. ..... 81/3.55; 81/3.57; 81/3.47

(58) Field of Classification Search ..... 81/3.09, 81/3.55, 3.47, 3.57, 3.48, 3.49
See application file for complete search history.

(56) References Cited

U.S. PATENT DOCUMENTS 928,156 A * 7/1909 Rydquist ..... 81/3.57
1,284,666 A * 11/1918 Harding ..... 81/3.49
1,696,920 A * 1/1929 Miller ..... 81/3.47
2,455,496 A * 12/1948 Kaskouras ..... 81/3.57
2,568,612 A * 9/1951 Cullen ..... 81/3.55
2,858,721 A * 11/1958 Horne, Jr. ..... 81/3.47
4,967,622 A 11/1990 Phillips
5,457,834 A * 10/1995 Allen, Sr. ..... 81/3.55
5,555,778 A 9/1996 Otters et al.
5,699,928 A 12/1997 Chung et al.
5,771,759 A 6/1998 Warren
5,913,953 A 6/1999 Eve et al.
2001/0037704 A1* 11/2001 Dismukes ..... 81/3.55

* cited by examiner

*Primary Examiner*—Debra S Meislin
(74) *Attorney, Agent, or Firm*—Cantor Colburn LLP

(57) ABSTRACT

A flip-top can opener comprising: a length of rigid material; a wedge-shaped head located at a distill end of the length of rigid material; a hook located near the wedge-shaped head, and configured to engage an edge of a rim of a flip-top can such that when the flip-top can opener is pivoted about the edge of the can, the wedge-shaped head enlarges an opening of the flip-top can.

9 Claims, 5 Drawing Sheets

METHOD AND APPARATUS FOR OPENING OF CONTAINERS

This application claims benefit of provisional application Ser. No. 60/406,074, filed Aug. 27, 2002.

TECHNICAL FIELD

The disclosed method and apparatus relate to a tool for the opening of containers. More particularly, the disclosed method and apparatus relate to a tool for the opening of flip-top beverage cans.

BACKGROUND

Beverage cans are commonly formed in a cylindrical cup-shaped configuration to which is crimped a lid having a finger tab-lever arrangement for depressing a scored tab to access the contents of the can, usually for drinking directly from the can or pouring from the opening created by the depressed scored tab. The lids are formed with an annular flange of an inverted U-shape, which is crimped to the upper edge of the can to form an upper rim. The finger tab is pinned or riveted to the lid near the center of the lid. When one end of the finger tab is lifted, the other end pivots about the rivet or pin and depresses the scored portion to provide an opening in the lid. This is a common design for flip-top cans, and the geometry and dimensioning of the lid varies very little, if at all, between vendors of different products.

Cans as described above are used for many beverages, including soft drinks, juices, beer and others. The lids for the cans are formed such that when the scored tab is depressed, a dam or lip is left in the lid, extending from the inside of the rim, which prevents some of the contents of the can from being easily consumed or being poured from the can.

SUMMARY

The disclosed apparatus relates to a flip-top can opener comprising: a length of rigid material; a wedge-shaped head located at a distil end of the length of rigid material; a hook located near the wedge-shaped head, and configured to engage an edge of a rim of a flip-top can such that when the flip-top can opener is pivoted about the edge of the can, the wedge-shaped head enlarges an opening of the flip-top can.

The disclosed apparatus also relates to a flip-top can opener comprising: a church key style can and bottle opener; and a wedge-shaped head attached to a bottle opening end of the church key style can and bottle opener.

The disclosed method relates to enlarging a flip-top can opening. The method comprises: pressing a wedge-shaped head into a flip-top can opening and dam formed in a flip-top can lid; and pushing a portion of the dam to a position where fluid may flow unrestrictedly from the flip-top can opening.

BRIEF DESCRIPTION OF THE DRAWINGS

Referring now to the figures, which are exemplary embodiments, and wherein like elements are numbered alike.

DETAILED DESCRIPTION

A detailed description of several embodiments of the disclosed apparatus and method are presented herein by way of exemplification and not limitation with reference to FIGS. 1–13.

Figure 1:
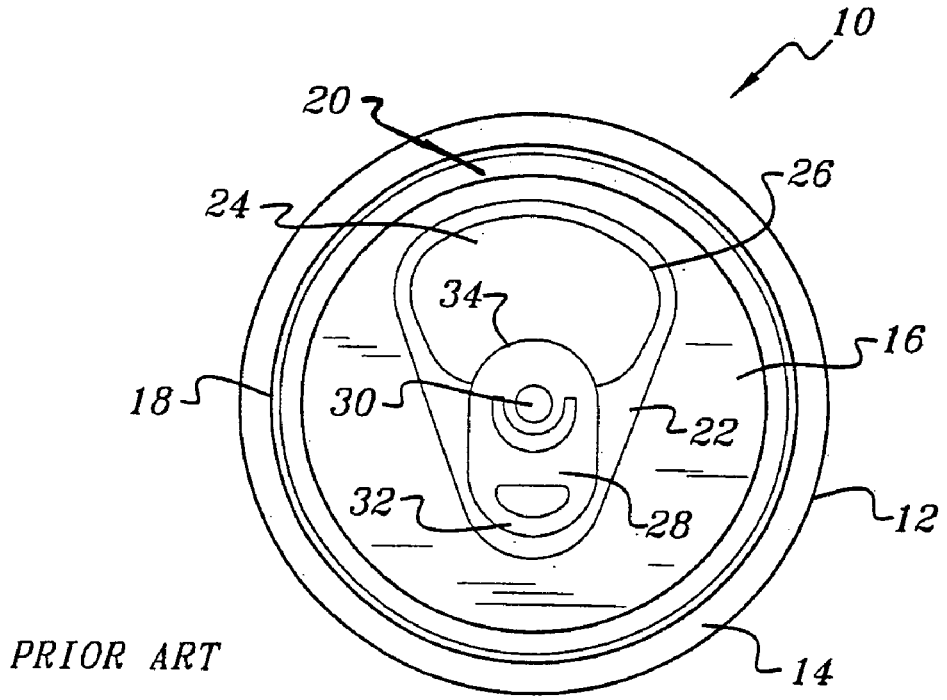
FIG. 1 is a view of the top of a typical unopened flip-top can.

A top view of an unopened typical flip-top can 10 is shown in FIG. 1. The flip-top can 10 comprises a cylindrical body 12 having an upper neck portion 14 (see also FIGS. 7 and 8). A lid 16 has an annular upstanding flange 18 of generally inverted U-shape (not seen in this view) which is crimped over the top of upper neck portion 14 to define a rim 20. Lid 16 is formed with an indented area 22, generally in the shape of a triangle with rounded corners. Within indented area 22 is a scored opening tab 24 of generally oval shape. When the scored opening tab 24 is partially broken away from lid 16 the can 10 is opened. Scored opening tab 24 is scored along line 26.

Still referring to FIG. 1, a finger tab 28 is pivotally secured to lid 16 by a pin or rivet 30 within indented area 22. Finger tab 28 comprises a finger lifting end 32 and a tab opening end 34.

To open can 10, the finger lifting end 32 is raised, usually, but not necessarily, by using a finger. As finger lifting end 32 is raised, tab 28 pivots about rivet 30, which in turn depresses tab opening end 34 into scored opening tab 24. This breaks scored opening tab 24 loose from lid 16 along score line 26 and bends it down to the position shown in FIG. 2, providing a pouring or drinking opening 36. However, a lip or dam 40 is left between opening 36 and the inside of annular upstanding flange 18. This lip or dam 40 will trap some liquid in the can, when the can is tilted to allow the liquid to pour out of the can 10. In order to completely empty the can, the can usually must be totally inverted, in which case it may be difficult to direct the last bit of liquid poured from the can.

To overcome this problem and prevent the loss or waste of liquid an opening tool 42 (FIGS. 3, 4, and 5) is disclosed. The tool 42 is a length of formed rigid material having a tapered end 44, as shown in the side view of FIG. 4. The rigid material may be selected from a metal, plastic or composite. Tapered end 44 may be easily slipped under finger lifting end 32 of finger tab 28 in order to bend finger tab 28 upwardly toward the position shown in FIG. 7 to open can 10.

Figure 2:
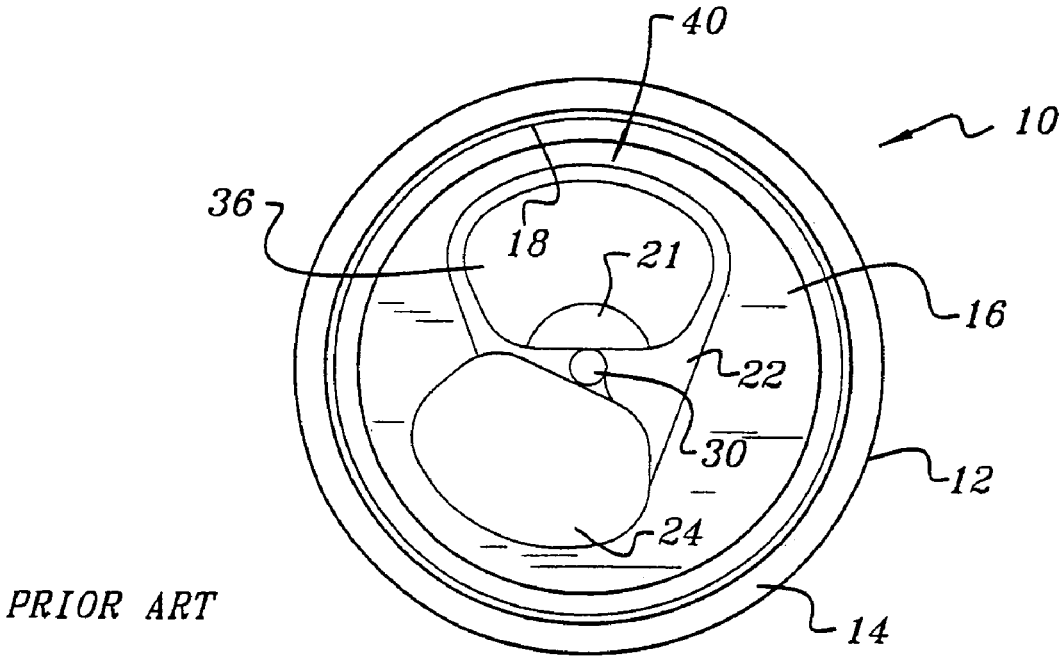
FIG. 2 is a view of the top of the can of FIG. 1 seen from the inside thereof after the can has been opened.
Figure 7:
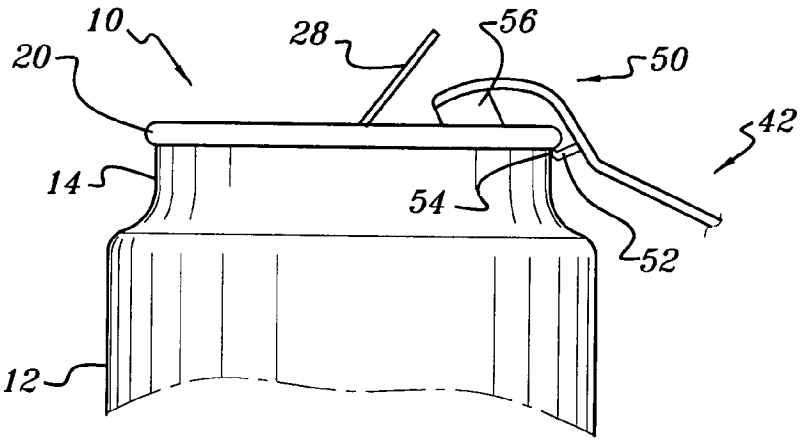
FIGS. 7 and 8 are side views of flip-top cans and with the tool of FIGS. 3–5 in use thereon.
Figure 8:
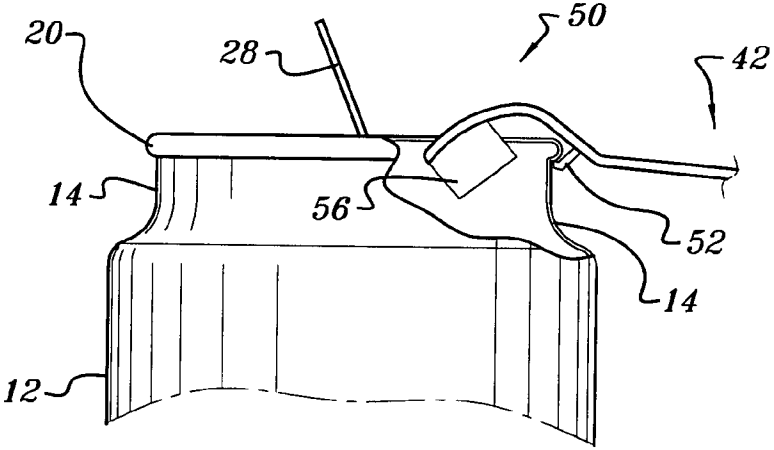
Figure 6:
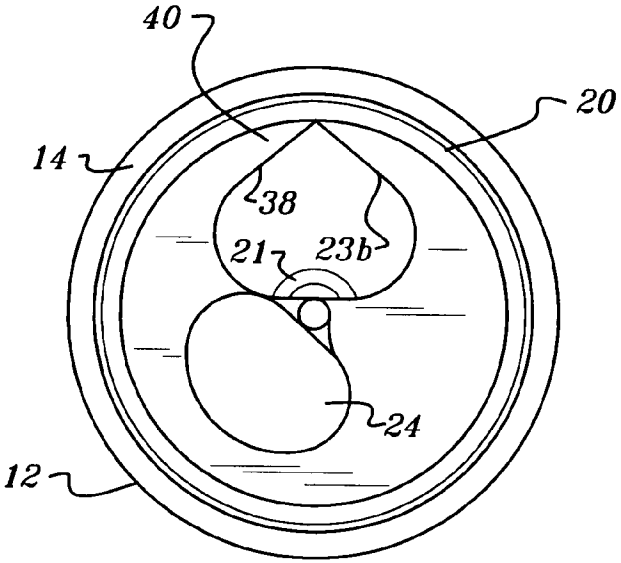
FIG. 6 is a view similar to FIG. 2 after the can has been operated upon by the tool of FIGS. 3–5.
Figure 10:
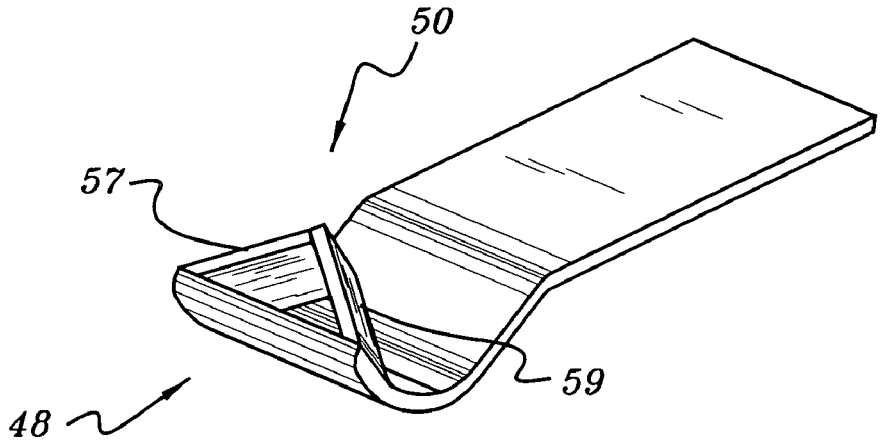
FIGS. 9 and 10 are perspective views showing a method of fabricating the wedge-shaped head.
Figure 9:
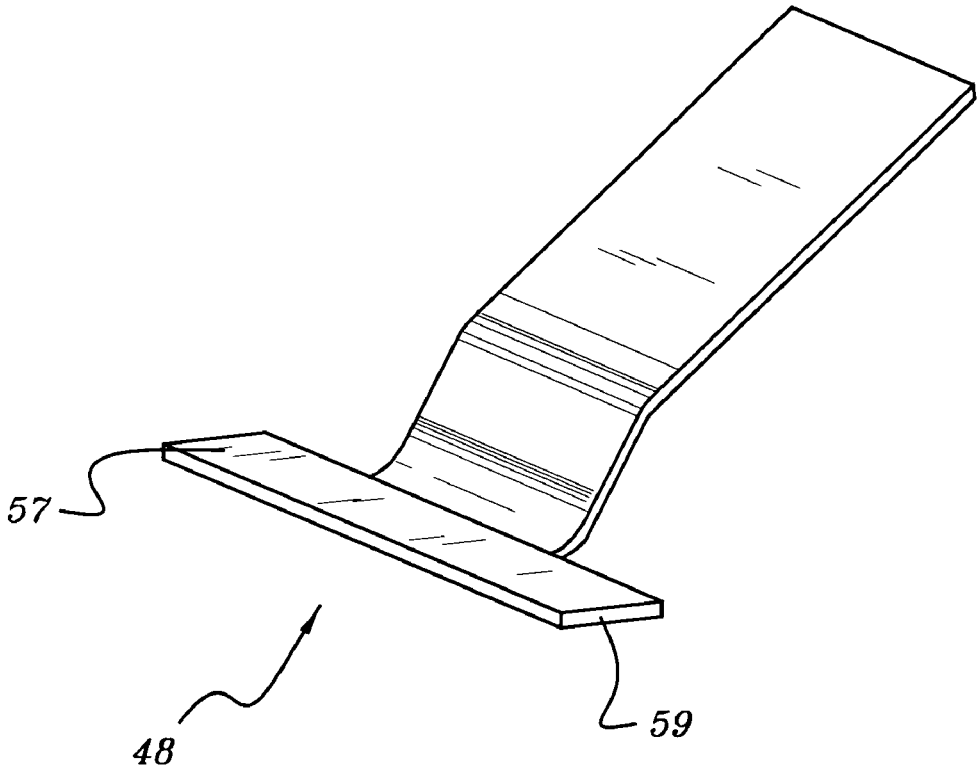

The distil end 48 of tool 42 is formed with a wedge-shaped head 50 which may be used to remove a portion of lip or dam 40 shown in FIG. 2, to produce an enlarged opening 38 as shown in FIG. 6. Head 50 may be formed on tool 42 by bending distil end 48 into the roughly "C" shape shown in FIG. 4. Prior to such bending a tab 52 should be struck from tool 42 to form a hook 54 which will engage the external edge of rim 20 as shown in FIGS. 7 and 8, and provide a pivot point for tool 42. The hook 54 will be near the wedge-shaped head 50. Then, the wedge-shaped head may be adhered to distil end 48 by a variety a methods, including but not limited to gluing and welding. The wedge-shaped head 50 may be comprised of a hard molded plastic, metal, composite or other material. Alternatively, the wedge-shaped head 50 may be formed by stamping wings 57, 59 into length of rigid material at a distil end 48. FIG. 9 shows the wings 57, 59 extending from the distil end 48. The wings 57, 59 would then be bent to form the wedge-shaped head 50 as shown in FIG. 10.

In operation, tool 42 may initially be used to lift finger tab 28 by inserting tapered end 44 underneath finger tab 28 preferably to rivet 30 and pivoting finger tab 28 upward thereby depressing scored opening tab 24 and breaking it along most of score line 26. This will result in tab 24 assuming the position as seen from the inside of the can in FIG. 2. At this point, the lip or dam 40 still remains. The user may, if desired, use his or her finger to lift finger tab 28 to a position shown in Figure in 8, and out of the way from the user when the user drinks from the can 10.

The term "user" is used herein to identify someone using the tool 42 on a flip-top beverage can. The user will either pour the contents of the container into a cup or glass or drink directly from the can. If the user is going to pour the contents of the can into a cup or glass, the user may leave the tab 28 in about the position shown in FIG. 7 after opening the can. If the user is going to drink directly from the can, he or she may bend tab 28 back to approximately the position shown in FIG. 8 in order to keep tab 28 out of the way while drinking from the can.

As shown in FIGS. 7 and 8, the tool 42 is used by engaging hook 54 under the edge of rim 20 and positioned over opening 36 (FIG. 2). Then the tool is pivoted about hook 54 on rim 20 so that wedge-shaped head 50 enlarges opening 36 (FIG. 2) to an enlarged opening 38 with the lip or dam 40 pushed out of the way to allow an unimpeded flow of fluid out of the can 10, see FIG. 6.

Referring back to FIG. 5, the wedge-shaped head 50 has a first surface 58 and a second surface 60. The first surface 58 resides in a first plane. The second surface 60 resides in a second plane. The first plane and second plane intersect at an angle $\beta$. Angle $\beta$ may be between sixty-five 65 and one hundred forty-five 145 degrees and in exemplary embodiments may be about one hundred five (105) degrees. The 105 degree value for angle $\beta$ allows the wedge to enlarge a typically sized opening 36 used in many flip-top cans today. However, this angle may be adjusted for cans with non-standard dimensioning. The terms "first" and "second" are used in herein, are only for identification and differentiation purposes. A numerological order is not meant to be conveyed by the terms "first" and "second".

To ensure that all contents are removed from the can, the user may initially pour the contents into a suitable container such as a cup or glass. Then the user will use tool 42 as shown in FIGS. 7 and 8 to break the lip or dam 40 to the rim 20 as shown in FIG. 6 and enlarge opening 36 (FIG. 2) to the larger opening 38 shown in FIG. 6. Alternatively, the user after creating the opening 36 as shown in FIG. 2, may use the tool as shown in FIGS. 7 and 8 to create the larger opening 38 as shown in FIG. 6, and then pour the contents of can 10 into a conventional drinking container.

If the user wishes to drink directly from the can after opening the can as shown in FIG. 2, the user will bend tab 28 to approximately the position shown in FIG. 8. The user may then drink directly from the can until dam or lip 40 prevents further liquid flow, then use tool 42 as shown in FIG. 8 to bend down a portion of dam 40 against rim 20 and create the opening 38 as shown in FIG. 6. Alternatively, the user may utilize tool 42 to create opening 38 prior to drinking from the can.

A tool embodying the disclosed apparatus may be about three and one-half inches (3½") long and thus may easily be stored and carried to sporting events, picnics, etc. Tapered end 44 may have an aperture 62 to provide a means of hanging the tool on a hook for storage or even attachment to a key chain.

Figure 11:
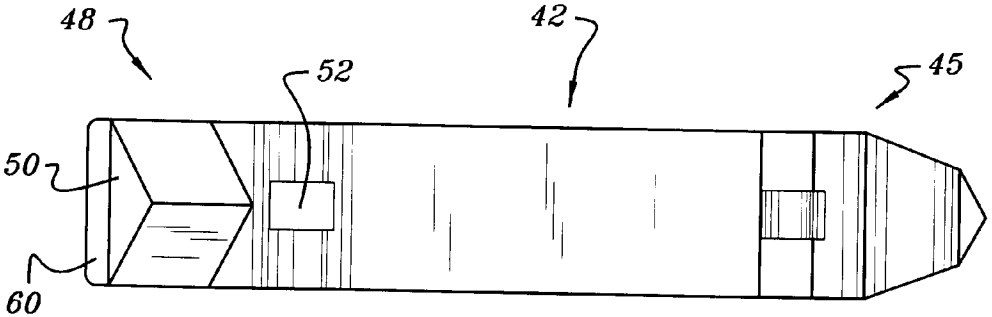
FIG. 11 is a top view of another embodiment of the disclosed apparatus.
Figure 13:
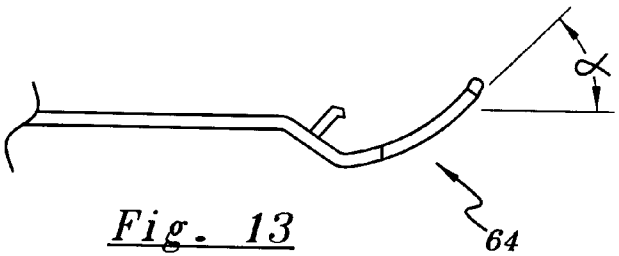
FIG. 13 shows a side view of a standard can opener end.
Figure 12:
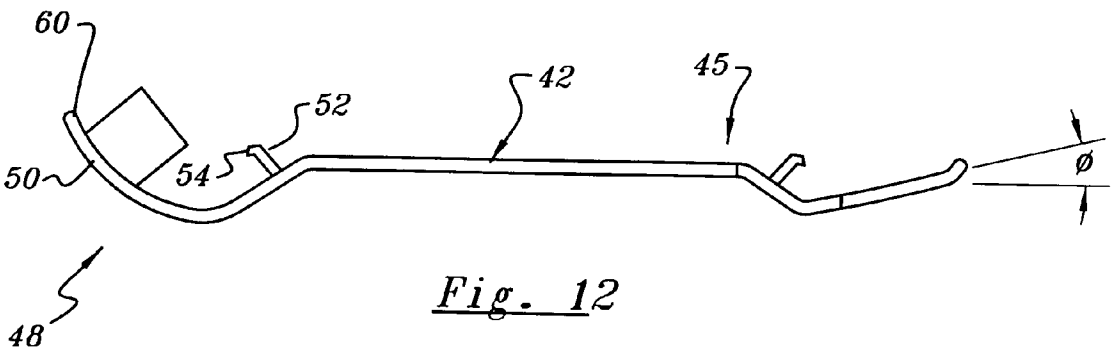
FIG. 12 is a side view of the apparatus of FIG. 11.

FIGS. 11, 12 and 13 disclose another exemplary embodiment of the disclosed apparatus. In FIG. 11, the wedge-shaped head 50 is no longer flush against the distil end of the opening tool 42 (as previously shown in FIG. 4), but rather leaves a small tip 66 at the distil end 48. This tip 66 may be used to lift the finger tab 28. In addition, in this embodiment there is no tapered end 44, but rather there is a modified end 45. The modified end is similar to a standard can opener (non-flip-top) end 64, (as shown in FIG. 13). However, angle $\phi$ from FIG. 12 may be about 15 degrees less than angle $\alpha$ from FIG. 13 in an exemplary embodiment. Angle $\phi$ may be between 5 to 30 degrees less than angle $\alpha$ in other exemplary embodiments. The 15 degree angle $\phi$ gives modified end 45 the advantage of allowing it to be able to open not only a non-flip-top can, but allows it to remove the cap off a bottle, such as a soda pop bottle. In other embodiments, modified end 45 may be replaced by a standard can opener end 64. Whether modified end 45 of standard can opener end 64 is used, both ends may be used to open finger tab 28.

Figure 3:
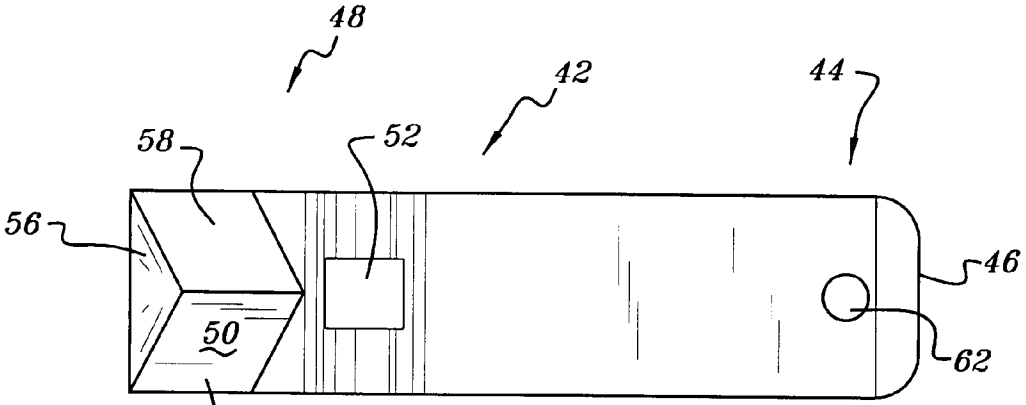
FIG. 3 is a top view of a tool embodying the invention.
Figure 4:
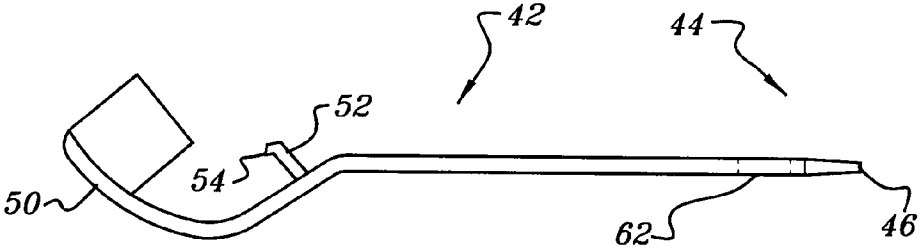
FIG. 4 is a side view of the tool of FIG. 3.
Figure 5:
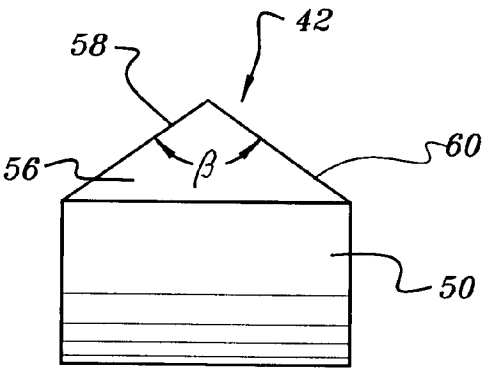
FIG. 5 is an end view of the tool of FIG. 3 seen from the left side of FIG. 3.

If opening tool 42, from FIGS. 3 and 4, did not have the wedge of the wedge-shaped head 50, and instead of the tapered end 44 had the standard can opener end 64 from FIG. 13, then it would be a basic bottle and can opener, which is commonly known as a "church-key". Therefore, an embodiment of a method of forming a new opening tool 42 would be to begin with a standard church key style can & bottle opener. Attach a wedge on the bottle opener end. The attaching method may be by, but not limited to: welding, epoxying or gluing. The can opening end may then be slightly straightened so that angle $\alpha$ is reduced approximately 15 degrees to about angle $\phi$.

The disclosed method and apparatus not only have the advantage of enabling all liquid contents of a can to be accessed, but also have the advantage of eliminating spillage of liquid which might occur when the can is thrown away or stored for later return for deposit refund. If not eliminated, such spillage may attract insects. Another advantage of the disclosed apparatus is that it provides a flip-top can opener that is simple to construct. The disclosed apparatus also have the advantage of providing for quick and easy lifting of the finger tab of a flip-top can. Another embodiment of the disclosed apparatus has the advantage of being able to enlarge a flip-top can opening, and to both be able to open a bottle and a non-flip-top can.

It should be understood by those skilled in the art that various changes may be made and equivalents may be substituted for elements thereof without departing from the scope of the disclosed method and apparatus. In addition, many modifications may be made to adapt a particular situation or material to the teachings of the disclosed method and apparatus without departing from the essential scope thereof. Therefore, it is intended that the disclosed method and apparatus not be limited to the particular embodiments disclosed as the best mode contemplated for carrying out the disclosed method and apparatus, but that the disclosed method and apparatus will include all embodiments falling within the scope of the appended claims.

What is claimed is:

1. A flip-top can opener comprising:

a length of rigid material having an upper surface and a lower surface;

a wedge-shaped head located on the lower surface at a distal end of the length of rigid material, the wedge-shaped head having a first surface, a second surface, and an intersecting edge defined by the first and second surfaces; and a hook extending from the length of rigid material proximate to the wedge-shaped head, the hook being configured to engage a portion of a rim of a flip-top can such that when the flip-top can opener is pivoted about the portion of the rim, the intersecting edge engages a lid of the can in a manner that substantially removes a portion of the lid of the can disposed between an opening and the rim, wherein a fluid in the can flows through an enlarged opening of the can.

2. A flip-top can opener comprising:

a length of rigid material;

a wedge-shaped head located at a distal end of the length of rigid material, the wedge-shaped head having a first surface, a second surface, and an intersecting edge defined by the first and second surfaces; and a hook extending from the length of rigid material proximate to the wedge-shaped head, the hook being configured to engage a portion of a rim of flip-top can such that when the flip-top can opener is pivoted about the portion of the rim, the intersecting edge engages a lid of the can in a manner that substantially removes a portion of the lid of the can disposed between an opening and the rim, wherein a fluid in the can flows through an enlarged opening of the can, and the wedge-shaped head is not flush against the distal end of the length of rigid material, wherein the length of rigid material between the distal end and the wedge-shaped head is used to lift a portion of a tab of the flip-top can.

3. The flip-top can opener of claim 2, wherein the first and second surfaces intersect at an angle between 65 and 145 degrees to each other, thereby defining the intersecting edge.

4. The flip-top can opener of claim 2, wherein the first and second surfaces intersect at an angle of about 105 degrees to each other, thereby defining the intersecting edge.

5. The flip-top can opener of claim 2, further comprising:

a tapered end configured to slip under a finger tab on the flip-top can in order to bend the finger tab upwardly thereby opening the flip-top can.

6. The flip-top can opener of claim 2, further comprising:

a modified end opposite the distal end, the modified end having an extending portion, an insertion portion, and a hook, the extending portion angularly extending away from the length of rigid material, the insertion portion disposed at a free end of the extending portion, and the hook angularly depending away from the modified end generally in the same direction as the extending portion, wherein the hook engages a portion of the rim of the can such that the can opener pivots about the portion of the rim and the insertion portion creates an opening in the lid of the can, or wherein the hook engages a portion of a cap of a bottle such that the can opener pivots about the portion of the cap in a manner that the modified end removes the cap from the bottle.

7. The flip-top can opener of claim 2, wherein the rigid material is a plastic.

8. The flip-top can opener of claim 2, wherein the rigid material is a metal.

9. The flip-top can opener of claim 2, wherein the rigid material is a composite.

* * * * *